US006764277B2

(12) United States Patent
Somahara et al.

(10) Patent No.: US 6,764,277 B2
(45) Date of Patent: Jul. 20, 2004

(54) FAN GUARD OF FAN UNIT

(75) Inventors: Koji Somahara, Sakai (JP); Toshihiko Takayama, Sakai (JP); Makoto Momosaki, Kakogawa (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/257,042

(22) PCT Filed: Jan. 18, 2002

(86) PCT No.: PCT/JP02/00636

§ 371 (c)(1),
(2), (4) Date: Oct. 8, 2002

(87) PCT Pub. No.: WO02/061343

PCT Pub. Date: Aug. 8, 2002

(65) Prior Publication Data

US 2003/0138321 A1 Jul. 24, 2003

(30) Foreign Application Priority Data

Jan. 29, 2001 (JP) ..... 2001-020482

(51) Int. Cl.[7] ..... F04D 29/70

(52) U.S. Cl. ..... 415/121.2; 416/247 R; 417/423.9

(58) Field of Search ..... 415/121.2, 211.2, 415/191, 208.2; 416/247 R; 417/423.9

(56) References Cited

U.S. PATENT DOCUMENTS 5,118,252 A * 6/1992 Chaney ..... 415/119
5,466,120 A 11/1995 Takeuchi et al.
6,257,501 B1 * 7/2001 Roach et al. ..... 239/289
6,435,889 B1 * 8/2002 Vinson et al. ..... 439/247

FOREIGN PATENT DOCUMENTS

| | | |
|---|---|---|
| JP | 54-100135 | 8/1979 |
| JP | 56-10218 | 1/1981 |
| JP | 58-131382 | 9/1983 |
| JP | 60-62567 | 4/1985 |
| JP | 61-22165 | 1/1986 |
| JP | 61-96268 | 6/1986 |
| JP | 6-257795 | 9/1994 |

* cited by examiner

*Primary Examiner*—Edward K. Look
*Assistant Examiner*—J. M. McAleenan
(74) *Attorney, Agent, or Firm*—Shinjyu Global IP Counselors, LLP

(57) ABSTRACT

A fan guard 18 of an outdoor unit comprises an outer frame, a plurality of radiating ribs 27, and a plurality of annular ribs 28. The outer frame is disposed around the outer circumference of a lid member that is an air conditioner discharge port. The plurality of radiating ribs 27 are formed such that they radiate in the outer radial direction from the vicinity of the center of the outer frame 26 to the outer frame 26, and are curved in the rotational direction of a ventilation fan. The plurality of annular ribs 28 are integral with the radiating ribs 27, are concentrically disposed at a predetermined spacing in the radial direction around the center of the rotational axis of the ventilation fan, and are formed such that at least those in an outer circumference are slanted toward the outer radial direction to follow the flow of the air blown from the ventilation fan.

11 Claims, 5 Drawing Sheets

FAN GUARD OF FAN UNIT

TECHNOLOGICAL FIELD

The present invention relates to a fan guard, and more particularly, a fan guard for a ventilation unit that is mounted on an air port of a ventilation unit that has a ventilation fan.

BACKGROUND ART

A fan guard is provided in an air port of a ventilation fan in a ventilation unit in, for example, an outdoor unit of an air conditioner. The fan guard is a member for protecting the ventilation fan.

Conventional fan guards that are made from plastic and integrally formed into a plurality of radially disposed radiating ribs and a plurality of concentrically disposed annular ribs are well known. These types of plastic fan guards have a long, slender and flat shape along the axial direction of the ventilation fan in order to maintain strength and reduce pressure loss.

In the aforementioned conventional fan guard, when a propeller fan is used as a ventilation fan, the radiating ribs and the annular ribs easily create a problem in which they interfere with flow of air from the ventilation fan into the fan guard In other words, the air flow from the propeller fan is a swirling divergent flow that has a velocity component of a predetermined size in the rotational and axial directions of the propeller fan. With regard to this type of swirling divergent flow, because the radiating ribs and the annular ribs are flat along the axial direction of the ventilation fan, there is a fear that the radiating ribs and the annular ribs will collide with the air flow and generate vortices, and that this will give rise to pressure loss and the generation of noise.

In addition, because the wide space between the outer circumferential portions of the radiating ribs and the flat members of the annular ribs along the axial direction, problems exist in which the rigidity of the outer circumferential portions weaken and the rigidity of the fan guard in the thickness direction is easily lowered. When the rigidity in the thickness direction is lowered, there is a particular fear that the fan guard in a top-blowing outdoor unit will come into contact with the ventilation fan in the wintertime when snow accumulates on the fan guard and warps it.

DISCLOSURE OF THE INVENTION

An object of the present invention is to make a fan guard of a ventilation unit that can suppress pressure loss and noise, and maintain a high level of rigidity in the thickness direction.

A fan guard of a ventilation unit according to the first aspect of the present invention is mounted on an air discharge port of a ventilation unit having a ventilation fan, and is comprised of an outer frame, a plurality of first ribs, and a plurality of second ribs. The outer frame is disposed around the outer perimeter of the air discharge port. The plurality of first ribs extend radially outward from the vicinity of the center of the outer frame and are curved in the rotational direction of the ventilation fan. The plurality of second ribs are integral with the first ribs, and with the rotational axis of the ventilation fan as the center, are disposed in concentric rings that are spaced apart at a predetermined distance in the radial direction and at least those in the outer circumference are formed such that they follow the flow of blown air from the ventilation fan and are slanted toward the outer radial direction.

In the fan guard of ventilation unit, when the ventilation fan rotates and generates a flow of rotating divergent blown air in the rotational direction and the axial direction having a velocity component of a predetermined size, the flow of the blown air passes through the first ribs and the second ribs. At this time, because the first ribs are curved in the rotational direction, by curving them such that they follow the rotating divergent current of the blown air, it is difficult for the blown air to collide with first ribs, and it is to eliminate resistance to the blown air. In addition, the second ribs are slanted outward in the radial direction such that they follow the flow of blown air, and thus it is difficult for the flow of blown air to collide with the second ribs, and there is little resistance to the flow of blown air by the second ribs. Because of this, even if first and second ribs are provided, the flow of blown air is smooth, and pressure drop and noise can be suppressed. Moreover, because the second ribs are slanted to follow the flow of blown air, the width of the second ribs (the length of the thickness of second ribs in the direction that they intersect) are longer than when they are not slanted, and the resilience of the fan guard in the thickness direction can be maintained at a high level.

With the fan guard of the ventilation unit according to the second aspect of the present invention, the first ribs of the guard in the disclosure of the first aspect are formed such that they are slanted toward the downstream side of the rotational direction to follow the flow of air blown from the ventilation fan. In this situation, both the first and second ribs are slanted to follow the flow of the blown air, and thus the resistance to the flow of blown air can be further reduced and pressure drop and noise can be further suppressed.

With the fan guard of the ventilation unit according to the third aspect of the preset invention, the slanting angles of the first ribs and the second ribs of the guard disclosed in the second aspect are different, and built up portions are formed at the points where the first ribs and the second ribs intersect. In this situation, even when both first and second ribs are slanted outward and undercut portions are produced, the undercut portions can be eliminated with the built up portions. Because of this, it is easy to remove the fan guard from a mold, and is easy to integrally form the fan guard from plastic or the like. Moreover, because the cross sectional area of the fixed portion that enlarges the highest bending moment in the second ribs is large, the second ribs are even more resilient, and the resilience of the fan guard in the thickness direction can be maintained at an even higher level.

With the fan guard of the ventilation unit according to the fourth aspect of the present invention, the first ribs of the guard in the disclosure of the second or third aspect are formed such that they are slanted toward the downstream side of the rotational direction 20 to 40 degrees with respect to a first reference plane that is parallel to the rotational axis of the ventilation fan. In this situation, the slant of the first ribs are ideal with respect to the flow of the rotating blown air.

With the fan guard of the ventilation unit according to the fifth aspect of the present invention, the second ribs of the guard in the disclosure of the fourth aspect are formed such that they are slanted outward 5 to 15 degrees with respect to a cylindrical second reference plane that is concentric with the rotational axis of the ventilation fan. In this situation, the slant of the second ribs are ideal with respect to the spread of the rotating blown air.

The fan guard of the ventilation unit according to the sixth aspect of the present invention is a guard disclosed in any of the first through fifth aspects, and further comprises a closing plate, the closing plate facing a hub of a ventilation fan that is a propeller fan having a cylindrical hub positioned in the center thereof and a plurality of blades provided around the circumference of the hub and disposed in the same center as that of the rotational axis of the ventilation fan, and wherein the first ribs are formed such that they extend from the closing plate to the outer frame. In this situation, because the closing plate covers the portion of the hub in the ventilation fan that does not contribute to ventilation, it is easy to prevent a reverse flow of the ventilation fan.

With the fan guard of the ventilation unit according to the seventh aspect of the present invention, the closing plate of the guard disclosed in the sixth aspect has a circular shape that is larger than the diameter of the hub. In this situation, because the bases of the blades of the ventilation fan are also covered by the closing plate when a reverse flow is easily generated, it will be more difficult to generate a reverse flow.

With the fan guard of the ventilation unit according to the eighth aspect, the first ribs of the guard disclosed in any of the first through seventh aspects are formed in a trochoidal curve. In this situation, the curve of the first ribs will easily follow the flow of the blown air.

With the fan guard of the ventilation unit according to the ninth aspect of the present invention, only the second ribs on the outer circumference of the guard disclosed in any of the sixth through eighth aspects are slanted, and the second ribs in the inner circumference are not slanted. In this situation, because, from amongst the plurality of second ribs, the only slanted ribs are in the outer circumference where the velocity of the flow of blown air is fast and the flow easily extends outward, the mold for an integrally formed fan guard is easily manufactured.

With the fan guard of the ventilation unit according to the tenth aspect of the present invention, the second ribs in the guard disclosed in the ninth aspect that are slanted are those in the outer circumference beyond ⅓ of the length of blades in the radial direction of the ventilation fan. In this situation, because, from amongst the plurality of second ribs, the only slanted ribs are those in the outer circumference beyond ⅓ of the length of blades of the ventilation fan where the velocity of the flow of blown air is fast and the flow easily extends outward, the mold for an integrally formed fan guard is easily manufactured.

With the fan guard of the ventilation unit according to the eleventh aspect of the present invention, the second ribs in the guard disclosed in the ninth aspect that are slanted are those in the outer circumference beyond ½ of the outer diameter of the outer frame. In this situation, because, from amongst the plurality of second ribs, the only slanted ribs are those in the outer circumference beyond ½ of the outer diameter of the outer frame where the velocity of the flow of blown air is fast and the flow easily extends outward, the mold for an integrally formed fan guard is easily manufactured.

BEST MODE FOR CARRYING OUT THE INVENTION

Figure 1:
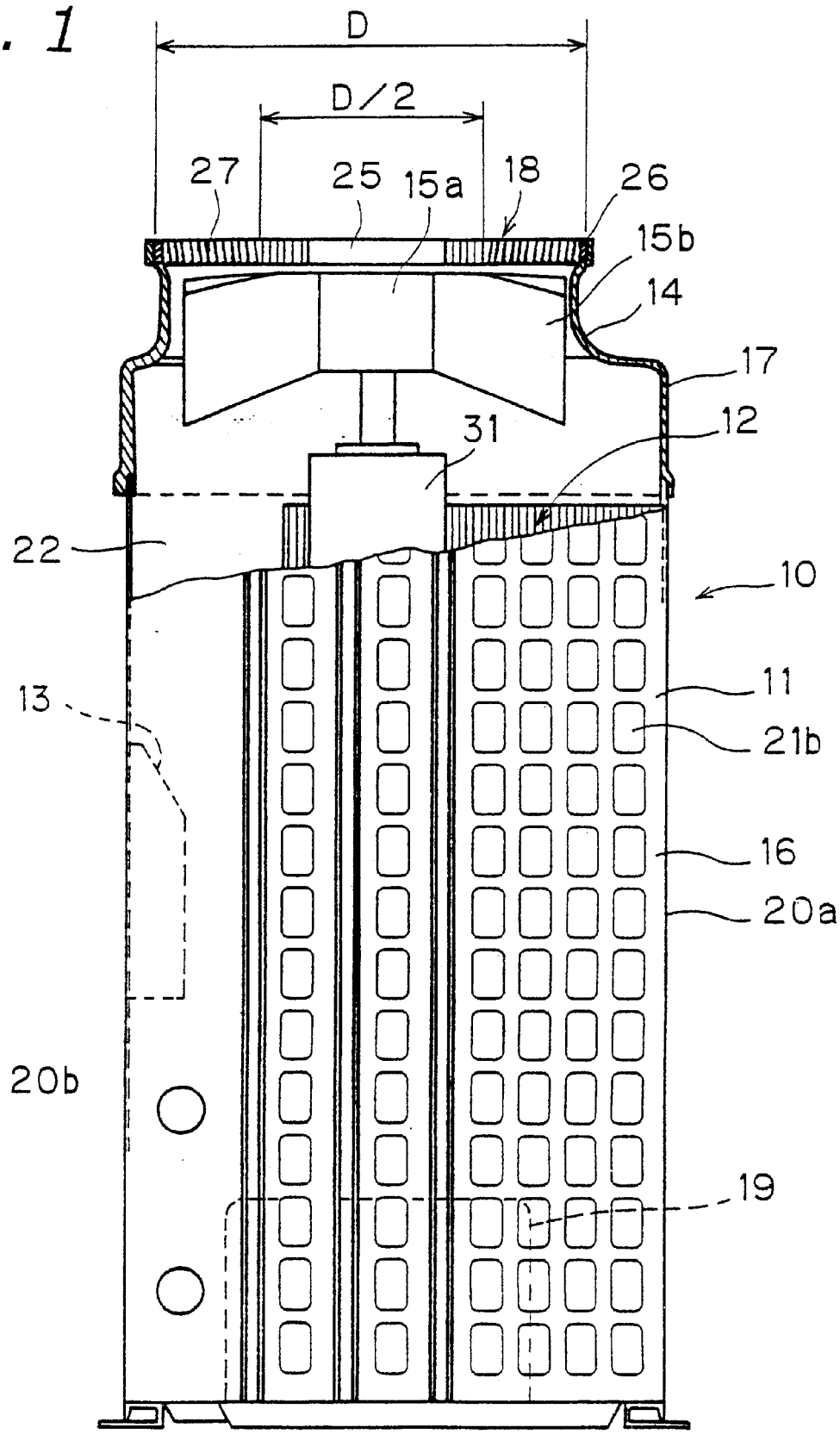
FIG. 1 is an outdoor unit of an air conditioner according to one embodiment of the present invention shown in partial cross-section.
Figure 2:
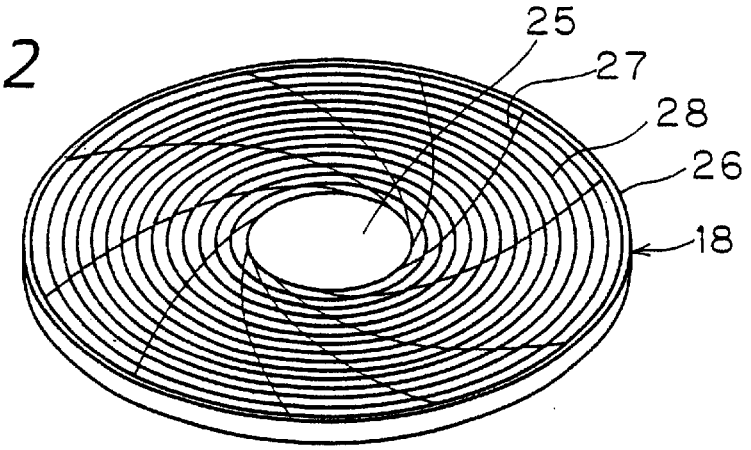
FIG. 2 is a perspective view of an upper portion of the outdoor unit shown in partial exploded and partial broken section.
Figure 2:
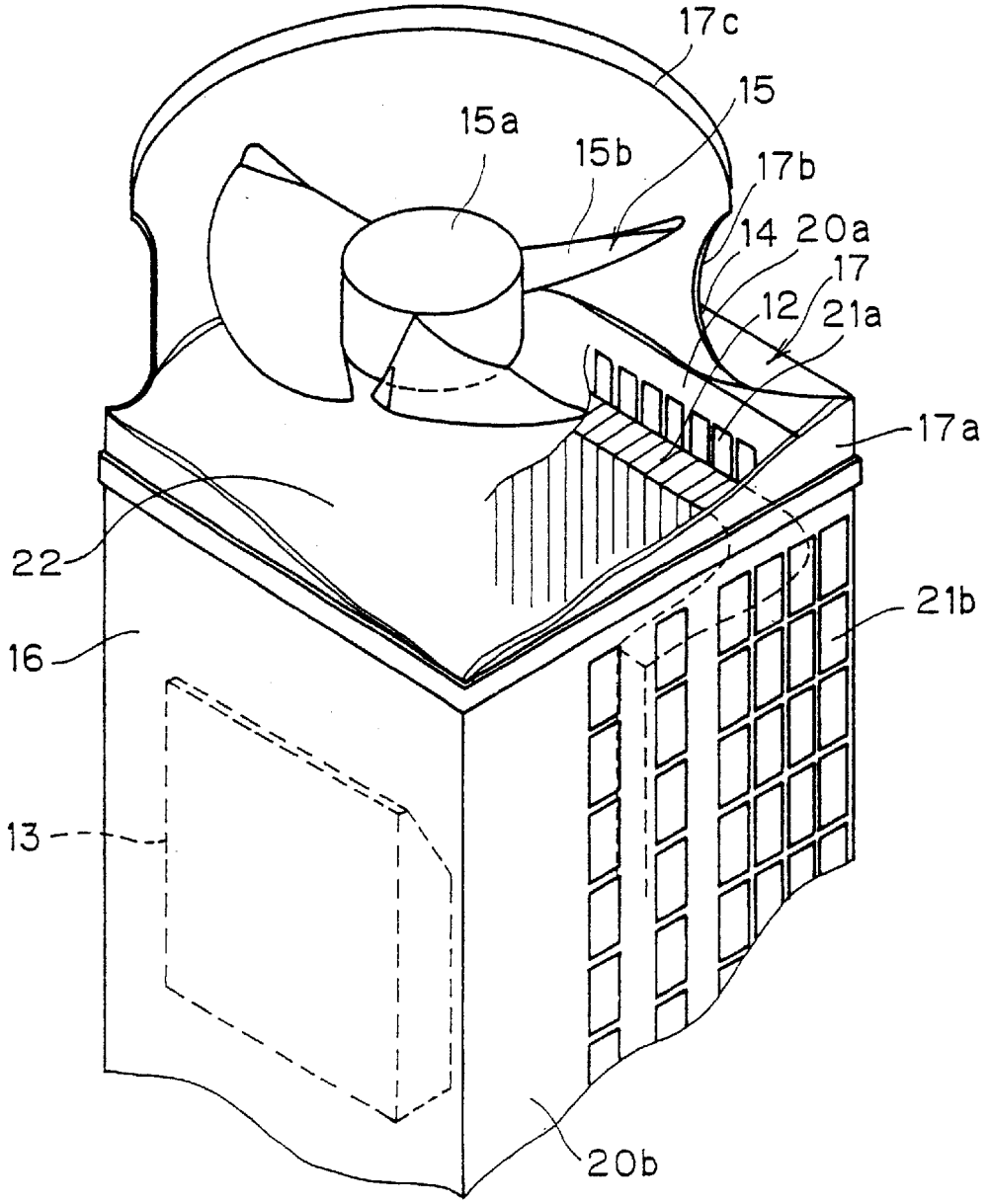
Figure 3:
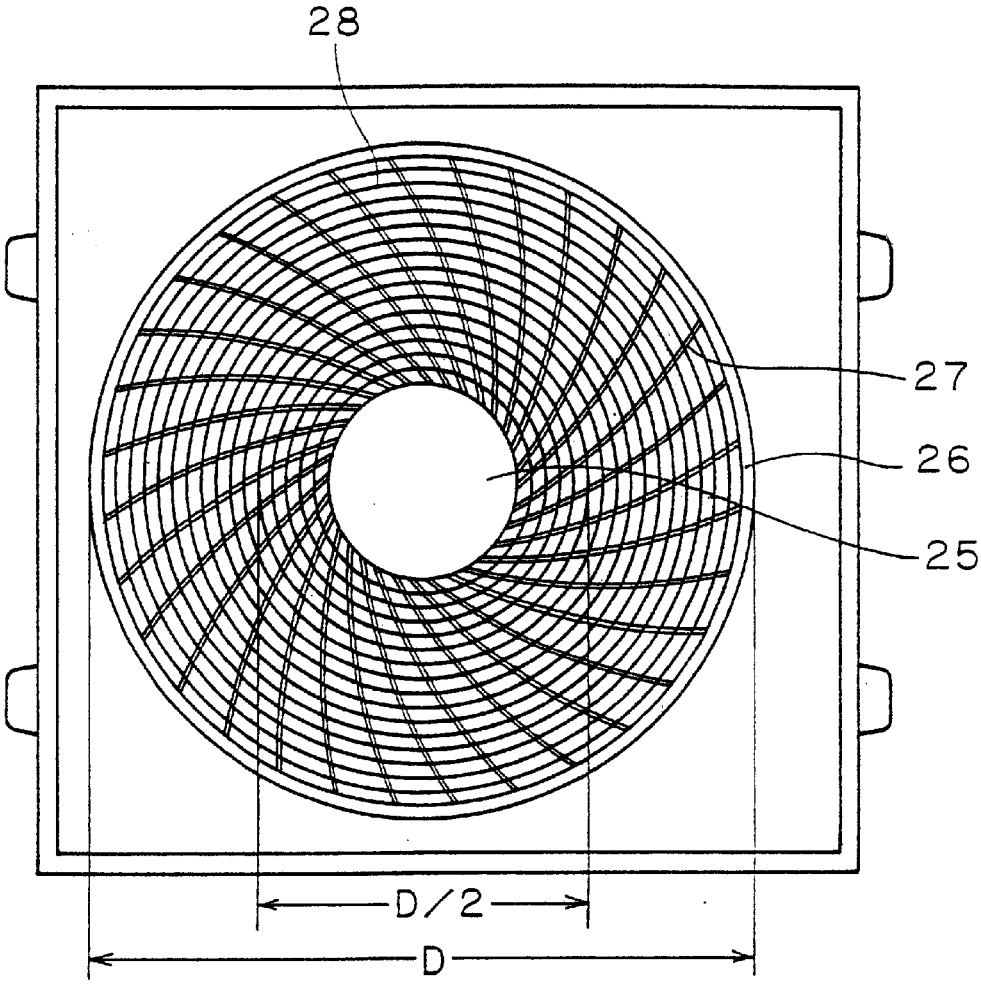
FIG. 3 is a plan view of the outdoor unit.

In FIGS. 1 to 3, an outdoor unit 10 (an example of a ventilation unit) of an air conditioner, in which an embodiment of the present invention has been adapted, is an top blowing model which takes in outside air from the sides, exchanges heat between the outside air taken in and refrigerant, and blows the air upward. The outdoor unit 10 is comprised of a casing 11, a heat exchanger 12 that is disposed inside the casing 11, a control unit 13 that faces the heat exchanger 12 and is disposed inside the casing 11, a ventilation fan 15 for taking in the outside air and blowing it out, a fan guard 18 according to one embodiment of the present invention that is fitted into the casing 11, and a compressor 19 that compresses the refrigerant.

The casing 11 has a rectangular shaped casing main body 16 that has an opening on the top thereof, and a lid member 17 that is mounted on the open portion of the casing main body 16. The casing main body 16 is a member made from sheet metal formed by drawing, for example, and has outside air intake ports 21*a*, 21*b* composed of a plurality of rectangular openings in a side wall 20*a* that is opposite the control unit 13 and in two side walls 20*b*, and further has a space 22 inside thereof.

The lid member 17 is a member that is integrally formed from plastic, and a generally cylindrical bell mouth 14 is formed thereon that extends vertically. The lid member 17 has a mounting portion 17*a* that has a rectangular outer shape and is mounted on the casing main body 16, a central portion 17*b* that narrows into a cylindrical shape from the mounting portion 17*a* and is formed by the bell mouth 14, and a circular guard attachment portion 17*c* that extends from the central portion 17*b*.

The ventilation fan 15 is a propeller fan having a cylindrical hub 15*a* positioned in the center thereof, and a plurality of blades 15*b* provided around the circumference of the hub, and is disposed inside the bell mouth 14. The ventilation fan 15 is rotatively driven by a motor 31 attached to the casing main body 16.

The fan guard 18 has a closing plate 25 positioned in the center thereof, an outer frame 26 positioned around the outer circumference thereof, a plurality of curved radiating ribs 27 (an example of the first ribs) that bind the closing plate 25 and the outer frame 26 together, and annular ribs 28 (an example of the second ribs) annularly disposed between the closing plate 25 and the outer frame 26. The fan guard 18 is, for example, integrally formed from plastic. The closing plate 25 is a circular part whose diameter is larger than that of the hub 15*a* of the ventilation fan 15. The outer frame 26 is a sleeve-shaped part whose diameter is larger than the outer diameter of the blades 15*b* of the ventilation fan 15. The outer frame 26 is fitted into the guard attachment portion, and the fan guard 18 is fitted into the lid member 17. The radiating ribs 27 are disposed such that they radiate out from the closing plate 25 to the outer frame 26 in the radial direction, and are formed such that they have a convex curve on the downstream side of the direction of rotation of the ventilation fan 15. In this way, it will be easy for the air blown from the ventilation fan 15 radially outward to follow the radiating ribs 27. Specifically, the radiating ribs 27 each have a convex curve on the downstream side of the direction of rotation of the ventilation fan 15 such that they are trochoidal in shape.

Figure 4:
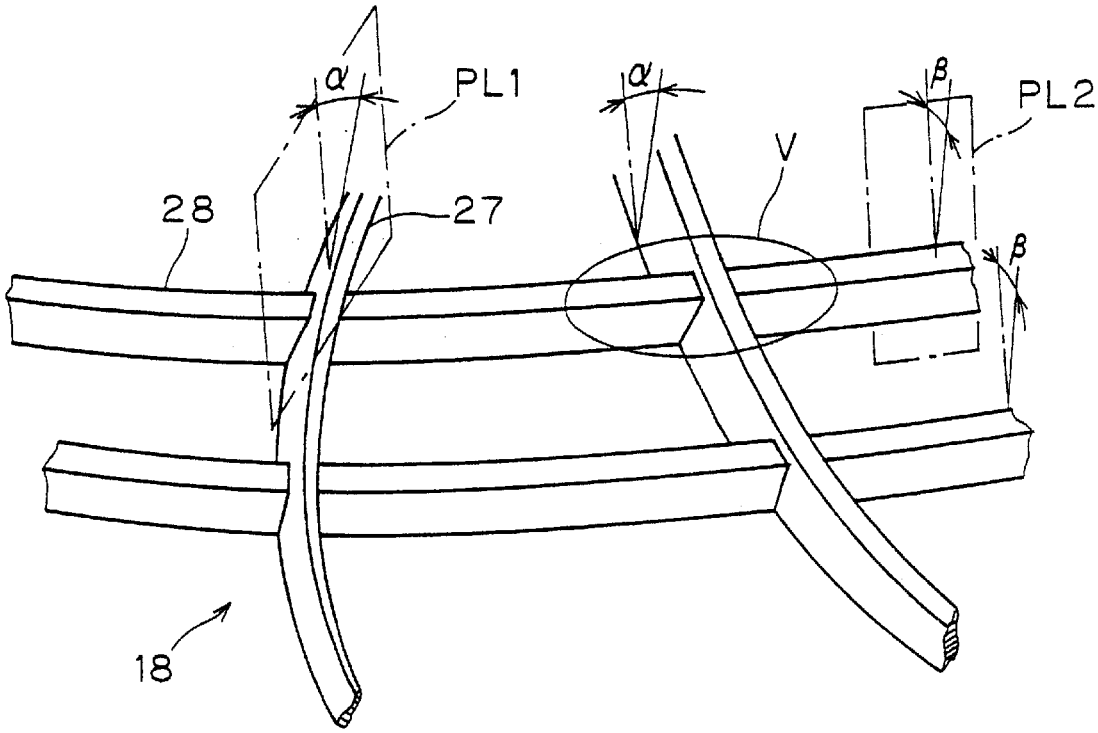
FIG. 4 is an enlarged perspective view of a fan guard.

As shown in FIG. 4, the radiating ribs 27 are formed such that they are slanted toward the downstream side of the direction of rotation of the ventilation fan 15 to follow the flow of the air blown out thereby. Specifically, the radiating ribs 27 are formed to slant toward the downstream side of the direction of rotation at a first angle α with respect to a first reference plane PL1 that is parallel to the axis of rotation of the ventilation fan 15. The range of the first angle α is preferably between 20 and 40 degrees, and more preferably in the vicinity of 30 degrees. When the first angle α is in the aforementioned range, it can approach the angle at which the velocity component of the air blown in the axial direction by the ventilation fan 15 at a radial position thereon is at a maximum, and the resistance to the blown air can be more effectively reduced.

The annular ribs 28 are concentrically disposed in the radial direction between the closing plate 25 and the outer frame 26 and are spaced apart with predetermined spacing. As shown in FIGS. 1 and 3, the annular ribs 28 disposed outside a straight line D/2 that is half the outer diameter D of the outer frame 26 are formed to lean in the radial direction along the flow of the air blown by the ventilation fan 15. Specifically, the annular ribs 28 are formed to slant outward in a direction at which the air is blown out at a second angle β with respect to a cylindrical second reference plane PL2 that are concentric with the rotational axis of the ventilation fan 15. The second angle β is preferably between 5 and 15 degrees, and more preferably in the vicinity of 10 degrees. Thus, by increasing the velocity of the blown air by slanting the annular ribs 28 on the outer circumference of the ventilation fan 15, resistance to the blown air can be more effectively reduced, and moreover, the annular ribs 28 are easier to produce than compared to the situation in which all of them are slanted.

Figure 5:
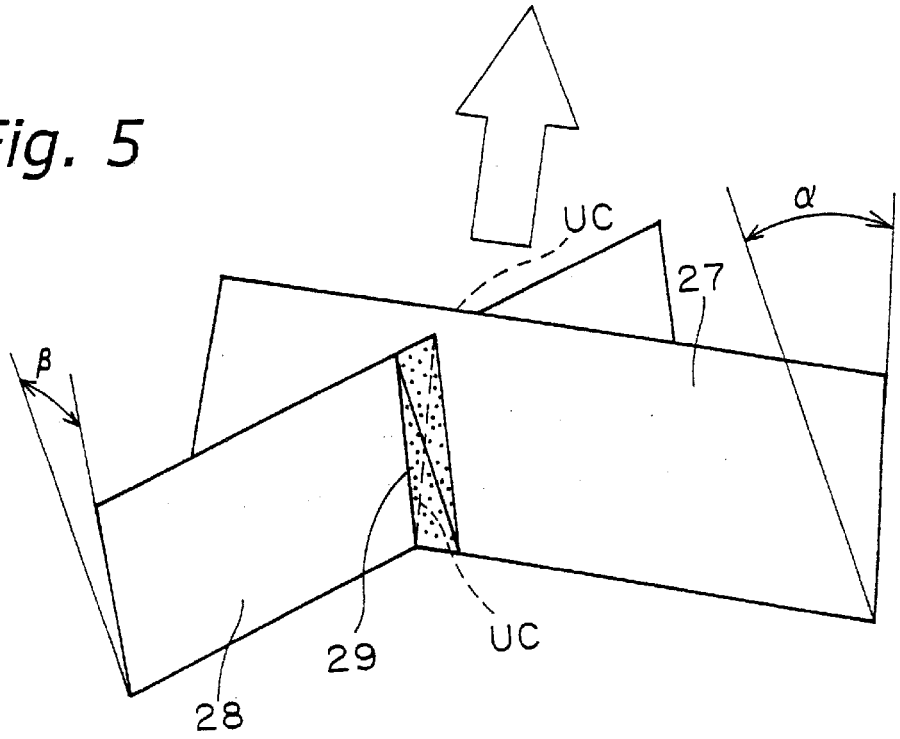
FIG. 5 is an enlarged view of portion V shown in FIG. 4.
Figure 6:
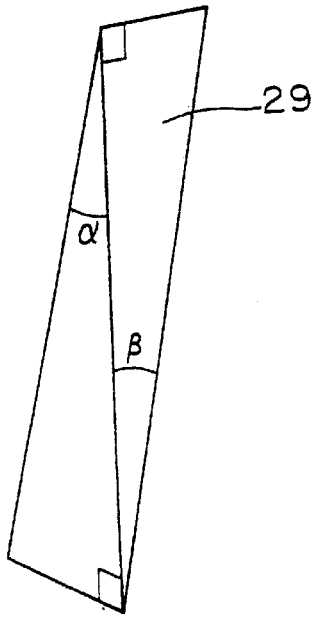
FIG. 6 is a perspective view of a built up portion.

When the radiating ribs 27 and the annular ribs 28 are formed integrally, an undercut portion UC, which is a portion left out from the molds, is formed at the intersection of the radiating ribs 27 and the annular ribs 28. Here, as shown in FIG. 5, the undercut portion UC is an intersecting portion that is left out from the molds when the molds are taken out in the air blow-out and air blow-in directions (upward direction and downward direction in FIG. 5) due to the fact that the ribs lean in the opposite directions. Because of this, a built up portion 29 is formed in the undercut portion UC. As shown in FIG. 6, the built up portion 29 is a four sided body composed of two right angled triangles that respectively have a first angle a and a second angle β therein. The built up portion 29 is formed in the two undercut portions UC on the intersecting portions. When this type of built up portion 29 is formed, split molds do not have to be employed, and thus it is easy to integrally form the fan guard 18, both edges of the annular ribs 28 will be strengthened at their highest bending moment by the built up portion 29, and the resilience of the annular ribs 28 will be high. Because of this, the resilience of the entire fan guard 18 in the thickness direction will be increased.

The heat exchanger 12 has a plurality of cooling fins, is disposed inside the casing 11 on the side walls 20*a*, 20*b* having outside air intake ports 21*a*, 21*b*, has refrigerant that flows therethrough, and exchanges heat with the air taken in. For example, during cooling, it exchanges heat between the refrigerant that was condensed in an indoor unit and the air that was taken in, and heats up the air. In addition, during heating, it exchanges heat between the air that was taken in and the compressed high temperature/high pressure refrigerant, and cools the air.

The control unit 13 controls the compressor 19 and the ventilation fan 15 of the outdoor unit 10 in accordance with the room temperature and the operational mode.

The compressor 19 compresses the refrigerant to a high temperature and high pressure, and during cooling, switches between a heat exchanger of the indoor unit (not shown in the figures) and the heat exchanger 12 and then transmits this refrigerant.

In an outdoor unit 10 constructed in this manner, when the ventilation fan 15 rotates, air passes through the heat exchanger 12 via the outside air intake ports 21*a*, 21*b*, and is taken into the casing 11. The air that is taken in passes through the fan guard 18 by means of the ventilation fan 15 and is blown outside.

At this time, when the air passes through the fan guard 18, because the closing plate 25 is larger than the diameter of the hub 15*a* of the ventilation fan 15, counter-current flow that is easily produced in the vicinity of the base of the blades 15*b* can be reliably prevented. In addition, because the radiating ribs 27 are curved in the rotational direction and slanted toward the downstream side in the rotational direction such that they follow the flow of air from the ventilation fan 15, and because the annular ribs 28 are also slanted toward the outer radial direction in accordance with the flow of air, it will be difficult for the flow of air to collide with the two types of ribs 27, 28 and pressure drop and noise can be suppressed.

In addition, because the annular ribs 28 are slanted outward toward the radial direction, the width of the annular ribs 28 (the length of the thickness of the annular ribs 28 in the direction in which they intersect) can be made longer than when they are not slanted, and the fan guard 18 can maintain its resilience in the thickness direction for a long period of time. Moreover, because built up portions 29 are formed in the undercut portions UC of the intersecting portions of the radiating ribs 27 and the annular ribs 28, the strength of both edges at the greatest bending moment of the annular ribs 28 is further increased by the built up portions 29, and resilience of the annular ribs 28 is further increased. Because of this, the resilience of the entire fan guard 18 in the thickness direction is further increased.

Other Embodiments (a) In the aforementioned embodiment, the radiating ribs are slanted downstream in the rotational direction. However, it is possible that only the annular ribs 28 be slanted outward in the radial direction, and for the radiating ribs 27 to not be slanted.

(b) In the aforementioned embodiment, the built up portions 29 were formed in the undercut portions UC such that a split mold does not have to be employed and the fan guard 18 can be integrally formed in just an up and down mold, although it is possible to employ a split mold such that an undercut UC is formed. However, in this situation, because there will be a large number of undercut portions, manufacturing costs will increase and it will be difficult to obtain strengthened resiliency due to the built up portions.

(c) In the aforementioned embodiment, the annular ribs 28 outside the distance D/2 are slanted outward in the radial direction. However, it is possible for all of the annular ribs 28 to be slanted, or for the annular ribs 28 outside a predetermined fraction (for example, ⅓) of the length of the blades 15*b* of the ventilation fan 15 to be slanted.

(d) In the aforementioned embodiment, a propeller fan is illustrated as the ventilation fan 15 that is guarded by the fan guard 18. However, it is possible to employ an axial flow fan. In addition, an outdoor unit of an air conditioner is illustrated as the ventilation unit, but a ventilation unit on which a fan guard is mounted is not limited to an outdoor unit.

Industrial Applicability

In the invention according to claim 1, the first ribs are curved in the rotational direction, and thus by curving them such that they follow the rotating divergent current of the blown air, it is difficult for the blown air to collide with the first ribs, and it is easy to eliminate resistance to the blown air. In addition, the second ribs are slanted in the outer radial direction such that they follow the flow of blown air, and thus it is difficult for the flow of blown air to collide with the second ribs, and there is little resistance to the flow of blown air by the second ribs. Because of this, even if first and second ribs are provided, the flow of blown air is smooth, and pressure drop and noise can be suppressed. Moreover, because the second ribs are slanted to follow the flow of blown air, the width of the second ribs (the length of the thickness of second ribs in the direction that they intersect) are longer than when they are not slanted, and the resilience of the fan guard in the thickness direction can be maintained at a high level.

In the invention according to claim 2, because the first ribs and the second ribs are slanted to follow the flow of the blown air, the resistance to the flow of blown air can be further reduced and pressure drop and noise can be further suppressed.

In the invention according to claim 3, even in situations in which both first and second ribs are slanted and undercut portions are produced, the undercut portions can be eliminated by built up. Because of this, it is easy to remove the fan guard from a mold, and is easy to integrally form the fan guard from plastic or the like. Moreover, because the cross sectional area of the fixed portion that enlarges the highest bending moment in the second ribs is made large, the second ribs are even more resilient, and the resilience of the fan guard in the thickness direction can be maintained at an even higher level.

In the invention according to claim 4, the slant of the first ribs are adapted to the flow of the rotating blown air.

In the invention according to claim 5, the slant of the second ribs are adapted to the flow of the rotating blown air.

In the invention according to claim 6, the hub of the ventilation fan does not contribute to ventilation and is covered by the closing plate, and thus it is easy to prevent reverse flow from the ventilation fan.

In the invention according to claim 7, because the bases of the blades are also covered by the closing plate when a reverse flow is easily generated, it will be more difficult to generate a reverse flow.

In the invention according to claim 8, the curve of the first ribs is easily followed by the flow of the blown air.

In the invention according to claim 9, because, from amongst the plurality of second ribs, the only slanted ribs are in the outer circumference where the velocity of the flow of blown air is fast and the flow easily extends outward, the mold for an integrally formed fan guard is easily manufactured.

In the invention according to claim 10, because, from amongst the plurality of second ribs, the only slanted ribs are in the outer circumference beyond ⅓ of the length of blades of the ventilation fan, where the velocity of the blown air is particularly fast and the flow easily extends outward, the mold for an integrally formed fan guard is easily manufactured.

In the invention according to claim 11, because, from amongst the plurality of second ribs, the only slanted ribs are in the outer circumference beyond ½ of the length of blades of the ventilation fan, where the velocity of the blown air is particularly fast and the flow easily extends outward, the mold for an integrally formed fan guard is easily manufactured.

What is claimed is:

1. A fan guard (18) of a ventilation unit (10) that is mounted in an air discharge port (17) of the ventilation unit (10) having a ventilation fan (15), the fan guard 18 comprising:

an outer frame (26) mounted in the outer circumference of the air discharge port (17);

a plurality of first ribs (27) that are formed such that they are curved in the rotational direction of the ventilation fan (15) and radiate outward toward the outer frame 26 in the radial direction from the vicinity of a central member of the outer frame (26); and a plurality of second ribs (28) that are integral with the first ribs (27), concentrically disposed at a predetermined spacing in the radial direction from the rotational axis of the ventilation fan (15), and formed such that those in the outer circumference are slanted toward the outer radial direction to follow the flow of blown air from the ventilation fan (15), while those in the inner circumference are not slanted.

2. The fan guard (18) of the ventilation unit (10) according to claim 1, wherein the first ribs (27) are formed such that they are slanted toward the downstream side of the rotational direction of the ventilation fan (15) to follow the flow of the air blown therefrom.

3. The fan guard (18) of the ventilation unit (10) according to claim 2, wherein the first ribs (27) and the second ribs (28) are slanted at different angles, and a built up portion (29) is formed between the first ribs (27) and the second ribs (28) at the point where both ribs intersect.

4. The fan guard (18) of the ventilation unit (10) according to claim 1, wherein the ventilation fan (15) is a propeller fan having a cylindrical hub **(15*a*) positioned at the center thereof, and a plurality of blades (15*b*) positioned around the circumference of the hub (15*a*); and further comprising a closing plate (25) disposed such that it faces the hub (15*a*) and is concentric with the rotational axis of the ventilation fan(15)**;

wherein the first ribs (27) are formed to the extend of closing plate (25) to the outer frame (26).

5. The fan guard (18) of ventilation unit (10) according to claim 4, wherein the closing plate (25) has a circular shape that is larger than the diameter of the hub **(15*a*)**.

6. The fan guard (18) of the ventilation unit (10) according to claim 1, wherein the first ribs (27) are formed such that they curved in a trochoidal curve.

7. A fan guard (18) of a the ventilation unit (10) that is mounted in an air discharge port (17) of the ventilation unit (10) having a ventilation fan (15), the fan guard (18) comprising:

an outer frame (26) mounted in the outer circumference of the air discharge port (17);

a plurality of first ribs (27) that are formed such that they are curved in the rotational direction of the ventilation fan (15) and radiate outward toward the outer frame (26) in the radial direction from the vicinity of a central member of the outer frame (26), the first ribs (27) being formed such that they are slanted toward the downstream side of the rotational direction of the ventilation fan (15) to follow the flow of the air blown therefrom; and a plurality of second ribs (28) that are integral with the first ribs (27), concentrically disposed at a predetermined spacing in the radial direction from the rotational axis of the ventilation fan (15), and formed such that those in the outer circumference are slanted toward the outer radial direction to follow the flow of blown air from the ventilation fan 15, the first ribs (27) being formed such that they are slanted toward the downstream side of the rotational direction of the ventilation fan (15) to follow the flow of the air blown therefrom at an angle of 20 to 40 degrees with respect to a first reference plane (PL1) that is parallel with the rotational axis of the ventilation fan (15).

8. The fan guard (18) of the ventilation unit (10) according to claim 7, wherein the second ribs (28) are formed such that they are slanted at an angle of 5 to 15 degrees with respect to a cylindrical second reference plane (PL2) that is concentric with the rotational axis of the ventilation fan (15).

9. A fan guard (18) of a ventilation unit (10) that is mounted in an air discharge port (17) of the ventilation unit (10) having a ventilation fan (15), the fan guard (18) comprising:

an outer frame 26 mounted in the outer circumference of the air discharge port (17);

a plurality of first ribs (27) that are formed such that they are curved in the rotational direction of the ventilation fan (15) and radiate outward toward the outer frame (26) in the radial direction from the vicinity of a central member of the outer frame (26);

a plurality of second ribs (28) that are integral with the first ribs (27), concentrically disposed at a predetermined spacing in the radial direction from the rotational axis of the ventilation fan (15), and formed such that those in the outer circumference are slanted toward the outer radial direction to follow the flow of blown air from the ventilation fan (15); and a closing plate (25) disposed concentric with the rotational axis of the ventilation fan (15);

the ventilation fan (15) being a propeller fan having a cylindrical hub (15*a*) positioned at the center thereof and a plurality of blades (15*b*) positioned around the circumference of the hub (15*a*);

the closing plate (25) being disposed such that it faces the hub (15*a*), the first ribs (27) being formed to extend from the closing plate (25) to the outer frame (26), the second ribs (28) being formed such that only those in the outer circumference are slanted and those in the inner circumference are not slanted.

10. The fan guard (18) of the ventilation unit (10) according to claim 9, wherein the second ribs (28) in an outer circumferential region beyond ⅓ the length in the radial direction of the blades (15*b*) of the ventilation fan (15) are slanted.

11. The fan guard (18) of the ventilation unit (10) according to claim 9, wherein the second ribs (28) in an outer circumferential region beyond ½ of the outer diameter of the outer frame (26) are slanted.

* * * * *

UNITED STATES PATENT AND TRADEMARK OFFICE

CERTIFICATE OF CORRECTION

PATENT NO. : 6,764,277 B2
DATED : July 20, 2004
INVENTOR(S) : Koji Somahara et al.

It is certified that error appears in the above-identified patent and that said Letters Patent is hereby corrected as shown below:

Title page,
Item [86], delete "PCT/JP02/00636", and insert -- PCT/JP02/00363 --.

Signed and Sealed this

Second Day of November, 2004

JON W. DUDAS
*Director of the United States Patent and Trademark Office*